US008118111B2

(12) United States Patent
Armas

(10) Patent No.: US 8,118,111 B2
(45) Date of Patent: Feb. 21, 2012

(54) GRADER STABILIZER

(76) Inventor: David Armas, Homestead, FL (US)

( * ) Notice: Subject to any disclaimer, the term of this patent is extended or adjusted under 35 U.S.C. 154(b) by 0 days.

(21) Appl. No.: 12/017,043

(22) Filed: Jan. 20, 2008

(65) Prior Publication Data

US 2009/0183886 A1 Jul. 23, 2009

(51) Int. Cl.
*E02F 3/00* (2006.01)

(52) U.S. Cl. ..... 172/779; 172/810

(58) Field of Classification Search ..... 172/779, 172/810

See application file for complete search history.

(56) References Cited

U.S. PATENT DOCUMENTS

| | | | | | |
|---|---|---|---|---|---|
| 2,593,176 | A | * | 4/1952 | Patterson | 172/680 |
| 2,650,529 | A | * | 9/1953 | Tanke | 172/476 |
| 2,749,630 | A | * | 6/1956 | Nave | 172/821 |
| 2,952,472 | A | * | 9/1960 | McNeill | 280/43.23 |
| 2,994,544 | A | * | 8/1961 | Wolf | 280/43.23 |
| 3,307,275 | A | * | 3/1967 | Simi | 37/234 |
| 3,484,964 | A | * | 12/1969 | Jeffery, Jr. | 414/635 |
| 3,643,745 | A | * | 2/1972 | Betulius et al. | 172/413 |
| 3,822,751 | A | * | 7/1974 | Waterman | 172/821 |
| 4,019,268 | A | * | 4/1977 | Waterman | 37/219 |
| 4,073,345 | A | * | 2/1978 | Miller | 172/413 |
| 4,201,268 | A | * | 5/1980 | Frisbee | 172/812 |
| 4,221,267 | A | * | 9/1980 | Asal et al. | 172/821 |
| 4,405,019 | A | * | 9/1983 | Frisbee | 172/816 |
| 4,893,683 | A | * | 1/1990 | Horsch et al. | 172/821 |
| 4,962,816 | A | * | 10/1990 | Imon et al. | 172/821 |
| 5,069,296 | A | * | 12/1991 | Horsch | 172/825 |
| 5,375,663 | A | * | 12/1994 | Teach | 172/4.5 |
| 5,901,793 | A | * | 5/1999 | Frisbee | 172/816 |
| 6,168,348 | B1 | * | 1/2001 | Meyer et al. | 404/90 |
| 6,273,198 | B1 | * | 8/2001 | Bauer et al. | 172/825 |
| 6,360,459 | B1 | * | 3/2002 | Brookhart et al. | 37/442 |
| 7,021,398 | B1 | * | 4/2006 | Marshall | 172/788 |

* cited by examiner

*Primary Examiner* — Thomas Will
*Assistant Examiner* — Joel F. Mitchell
(74) *Attorney, Agent, or Firm* — Chris Van Dam; Christopher J. VanDam, PA

(57) ABSTRACT

The present device is generally a stabilizer bracket for small to mid-sized skid steer vehicles used to grade earth using a dozer blade in conjunction with remote grade control equipment (such as laser automation or other automated leveling system). The device is most suited to skid steer vehicles capable of using a variety of interchangeable front end accessories in addition to a dozer blade.

10 Claims, 9 Drawing Sheets

GRADER STABILIZER

BACKGROUND OF THE INVENTION

1. Field of the Invention

The present invention relates to earth moving equipment, and more particularly, to an improved earth moving grader stabilizer.

2. Description of the Related Art

Several designs for improvements to earth moving equipment have been designed in the past. None of them, however, includes a device that stabilizes an earth moving grader blade of small to medium-sized track-steer or skid-steer vehicles using a remote grade controller system.

Applicant believes that the closest reference corresponds to U.S. Pat. No. 4,893,683 issued to Horsch. However, it differs from the present invention because the Horsch device attempts to stabilize the dozer blade by geometry of the brackets and slots supporting the blade. The present device stabilizes the dozer blade by limiting only one axis of movement which permits greater control of the blade and stabilizes the blade for more precise control.

Other patents such as U.S. Pat. No. 4,923,015 issued to Barsby attempt to control a dozer blade by complex electronic sensing and mechanical correcting equipment where the present device uses a simple fixed bracket to instantly prevent unwanted blade movement instead of correcting the movement as it happens.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that grades a wide variety of soil types and site conditions in a highly accurate way.

It is another object of the present invention that does not require any additional ground contacting stabilizers.

It is another object of this invention to provide a device that can maneuver in restricted space and around sensitive objects and substrates.

It is still another object of the present invention to provide greater functionality to small to medium skid steer and track steer vehicles while retaining their ability to be used with the wide variety of available accessories.

It is yet another object of this invention to provide such a device that is inexpensive to manufacture, light weight and easy to maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
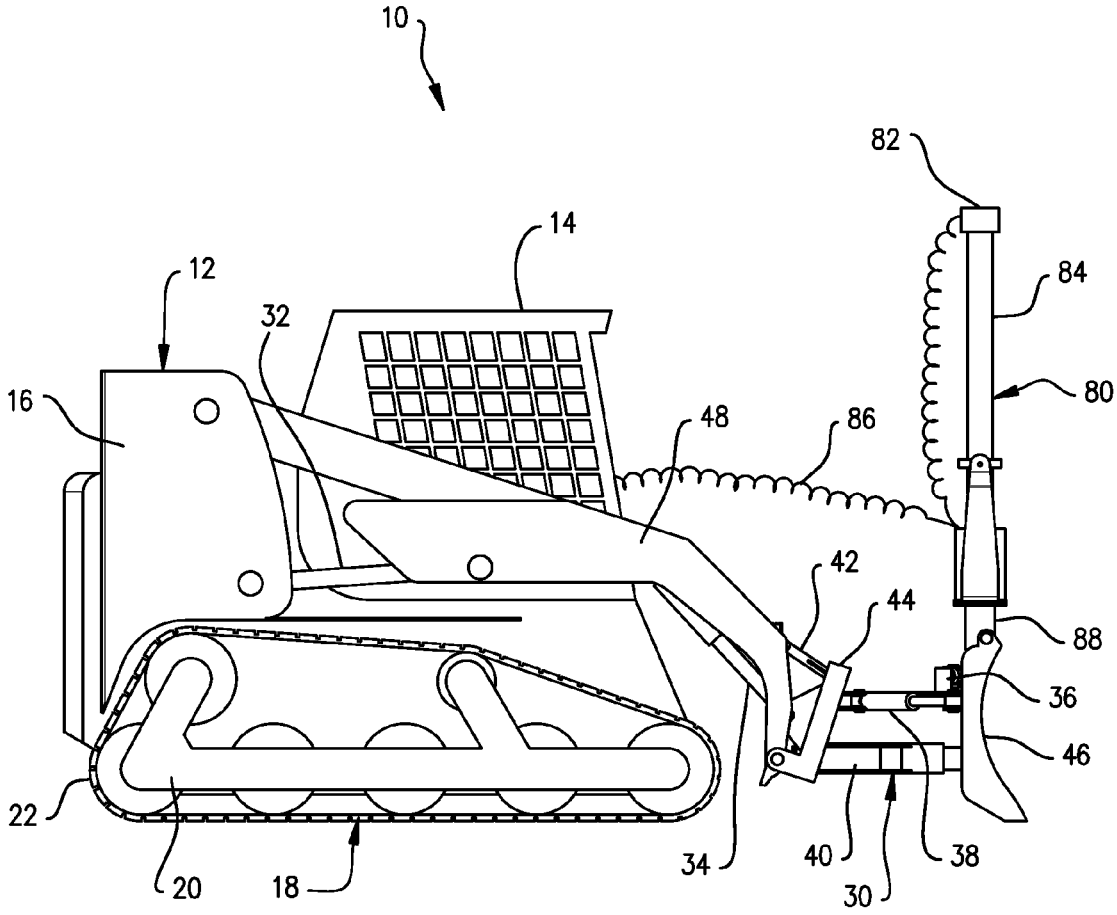
FIG. 1 represents a side elevation view of a track steer vehicle.

Skid steer vehicles are commonly commercially available. The skid steer vehicle that is preferred to work with the present device is small to medium sized and designed to accept any of a variety of front end accessories such as a dozer blade, pallet forks, a mower, a hole digger and several others. These front end accessories can be interchanged relatively easy with one or two men in a few minutes. The popularity of the small to medium sized skid steer class of vehicle is owed largely to the availability of the front end accessories by allowing a single vehicle to accomplish a wide variety of tasks without the need for specialty vehicles.

Grade control systems, such as laser automation, are commonly commercially available. An example is disclosed in U.S. Pat. No. 5,375,663 issued to Teach. Generally, the system works with a laser reference beacon erected on an edge of a job site at a known location and elevation established by survey. A laser receiver is attached to earthmoving equipment, typically onto the ground contacting blade, and sends a signal to a computer accessible to the operator of the earthmoving equipment. The computer is able to determine if the blade is above or below the desired grade and make adjustments as necessary to the blade height by controlling the hydraulics that move the blade.

What is claimed is a bracket. Said bracket is attached to a small to medium sized skid steer vehicle. Said skid steer vehicle having a main arm onto which various commercially available attachments could be connected to the skid steer vehicle. The skid steer vehicle having a dozer blade attachment attached to the main arm. Said dozer blade attachment having a hydraulic causing a pitch axis of movement of the dozer blade attachment relative to the main arm. Said bracket connecting said main arm and said dozer blade attachment to prevent movement of said hydraulic while retaining other available axis of movement of said dozer blade attachment and also being disconnectable from either or both of said main arm and dozer blade attachment.

The device may also include an automatic grade control system such as a laser leveler system with a remote laser beacon, a global positioning system automatic leveler or other system to aid the user of the device properly grade a surface.

The device may also comprise additional bracket(s) connecting said main arm and said dozer blade attachment to prevent movement of said hydraulic while retaining other available axis of movement of said dozer blade attachment.

The additional bracket(s) may be disconnectable from either or both of said main arm and dozer blade attachment.

The bracket may be dimensioned so that when the lower edge of said dozer blade attachment is at the same height as the bottom edge of said skid steer vehicle then the leading edge of said dozer blade attachment is substantially vertical.

The bracket attaches the main arm to the frame of a dozer blade assembly on a small to medium-sized skid steer vehicle that directly prevents the hydraulic responsible for pitch thereby stabilizing the dozer blade and a automatic grade leveling system to control the lift axis of the dozer blade.

Referring now to the drawings, where the present invention is generally referred to with numeral 10, it can be observed that it basically includes a tractor assembly 12, a track assembly 18, a blade assembly 30 and a leveler assembly 80.

Said tractor assembly 12 comprises, inter alia, an operator cage 14 and an engine case 16. An operator of the vehicle sits inside of and operates the vehicle from inside the operator cage 14. An engine inside the engine case 16 typically powers the vehicle including any hydraulics.

Said track assembly 18 comprises, inter alia, a suspension 20 and a track 22. In most applications a track steer vehicle will have complementary track assemblies 18 on both sides of the vehicle.

Said blade assembly 30 comprises, inter alia, a hydraulic 32, a hydraulic 36, a hydraulic 38, a frame 40, a bracket 42, a frame 44, a blade 46 and a main arm 48.

Said leveler assembly 80 comprises, inter alia, a receiver 82, a mast 84, a cable 86 and a bracket 88.

Figure 1A:
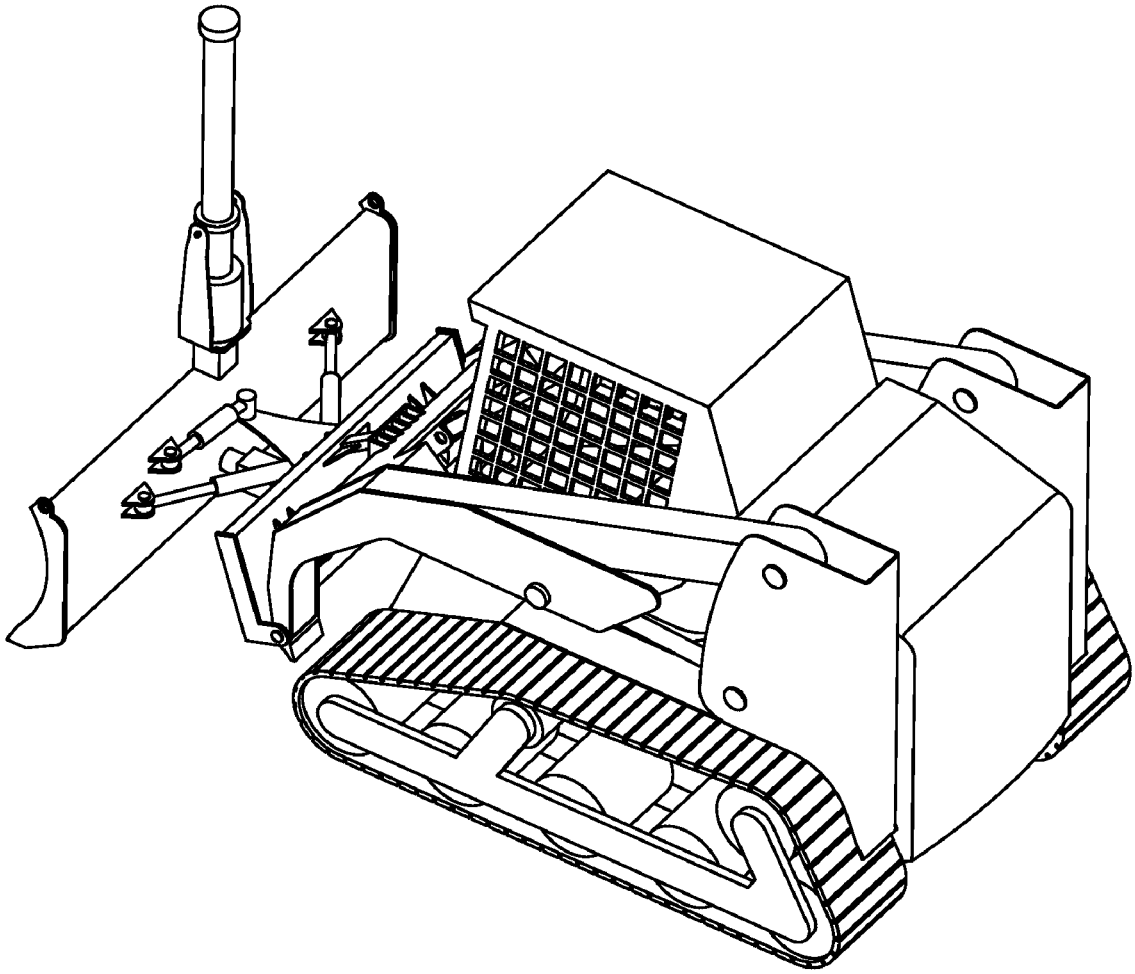
FIG. 1A is a perspective view of a track steer vehicle with the present device included.

FIG. 1A is an alternate view of the skid steer vehicle shown in FIG. 1.

Figure 2:
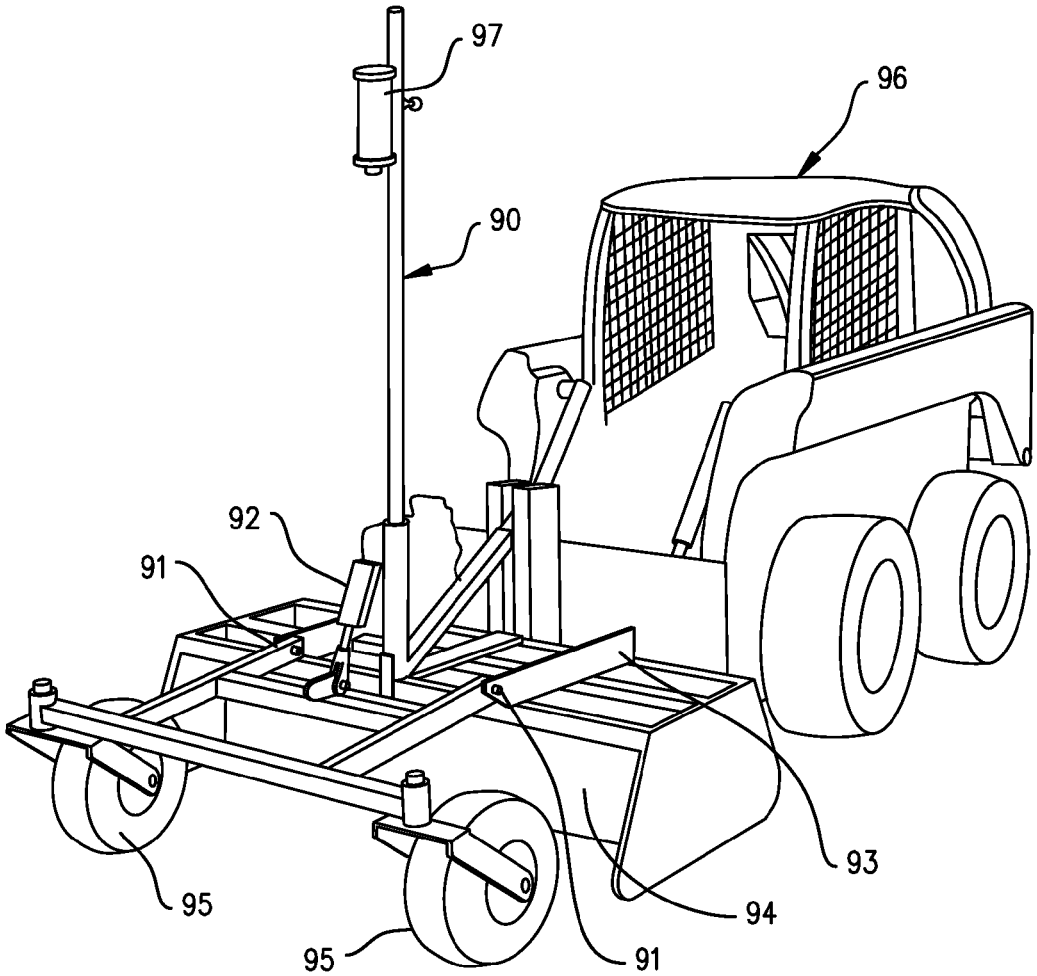
FIG. 2 shows a perspective view of the prior state of the art.

Referring now to FIG. 2 where the prior state of the art is shown to include, inter alia, a leveler assembly 90, a hinge 91, a hydraulic 92, a hinge 93, a blade 94, a wheel 95, a skid steer vehicle 96 and a receiver 97.

Said leveler assembly 90 is one of several front end accessories designed to work with small to medium skid steer vehicles 96. Said leveler assembly 90 is designed to be used with a grade control systems, such as laser automation. When in use grading soil an operator sits inside the skid steer vehicle 96 and programs a computer controller for the grade control system with a predetermined grade. Generally, the grade control system requires a remote beacon fixed at a known location. Typically the beacon is a laser set in place by a job surveyor on the edge of a job site. The receiver 97 is fixed relative to the blade 94 on a mast and receives a signal from the beacon. The computer controller is connected to the receiver 97 and determines whether the receiver 97, and thus necessarily the blade 94, are at the proper height for the predetermined grade. The computer controller automatically actuates the hydraulic 92 to adjust the height of the blade 94 relative to the wheels 95. Hinges 91 and hinge 93 bend as the hydraulic 92 is adjusted to the proper height.

The wheels 95 are necessary to carry the weight of the leveler assembly 90 for precise adjustment of the blade and stability of the leveler assembly 90. As can be appreciated by a user of a leveler assembly 90, because of the wheels 95 placement forward of the blade 94, the blade 94 cannot be brought closer to an object than the distance between the wheels 95 and the blade 94. This is often problematic when, for example, foundation piers (or other obstructions which cannot be graded over) have been placed prior to final grading of the job site. The solution has been to use the leveler assembly 90 as shown in FIG. 2 to rough-in the job and then grade by hand with a shovel or rake up to obstructions that the leveler assembly 90 was not able to get close enough to.

Another limitation of the prior art leveler assembly 90 as shown in FIG. 2 manifests itself when the leveler assembly 90 is used to grade rough surfaces or coarse material. A problem often occurs when the skid steer vehicle 96 is moving forward and the wheels 95 are leading. If wheels 95 encounter uneven surface, for example a rut, the wheels 95 will drop and cause the blade 94 to cut too deeply. Conversely if the wheels 95 encounter a protrusion, for example a rock, the wheels 95 will tend to climb the protrusion and lift the blade 94 above the required grade.

Yet another limitation of the prior art shown in FIG. 2 will be apparent to users of a similar prior art device is encountered when it is desirable to reverse the skid steer vehicle 96 and drag the blade 94 to contour the surface in confined spaces. The prior art shown in FIG. 2 functions well only while the skid steer vehicle 96 is moving forward.

Still another limitation of the prior art as shown in FIG. 2 is manifested when the desired grade is anything but flat and horizontal and perpendicular to plumb. In other words, the prior art is not readily capable of producing an inclined or sloped grade, only flat and level.

Figure 3:
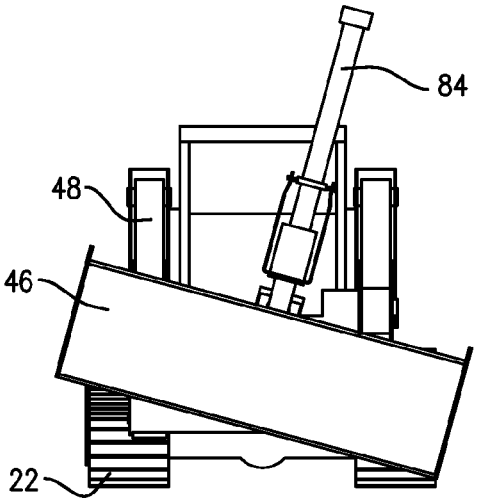
FIG. 3 is a front elevation view demonstrating blade roll left.
Figure 4:
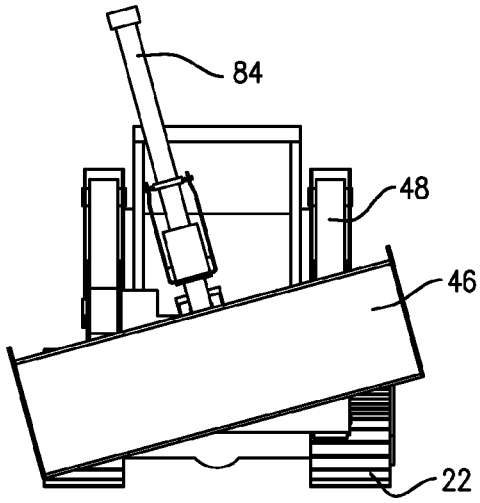
FIG. 4 is a front elevation view demonstrating blade roll right.

Now referring to FIGS. 3 and 4 where a front elevation view of a skid steer vehicle with a dozer blade attachment is shown. These views are to demonstrate the roll axis that the operator of the vehicle can move the blade. The roll axis is typically manipulated to produce an incline or sloped grade. The roll axis is controlled by hydraulic 36.

Figure 5:
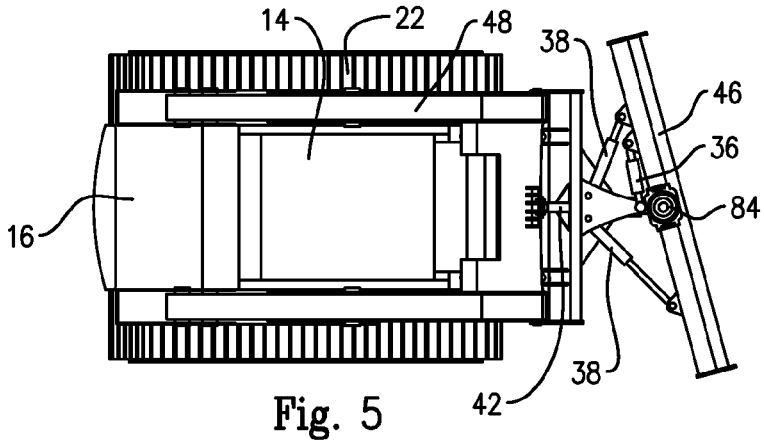
FIG. 5 is a top plan view demonstrating blade yaw left.
Figure 6:
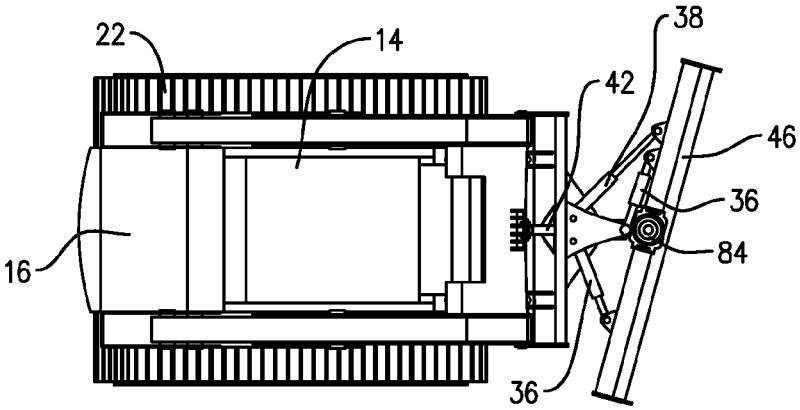
FIG. 6 is a top plan view demonstrating blade yaw right.

FIGS. 5 and 6 are a top plan view of a skid steer vehicle with a dozer blade attachment demonstrating the yaw axis that the operator of the vehicle can move the blade. The yaw axis is typically changed to push soil to one side of the skid steer vehicle. The change in yaw can be helpful in moving soil as part of the grading process. The yaw axis is controlled by hydraulics 38.

Figure 7:
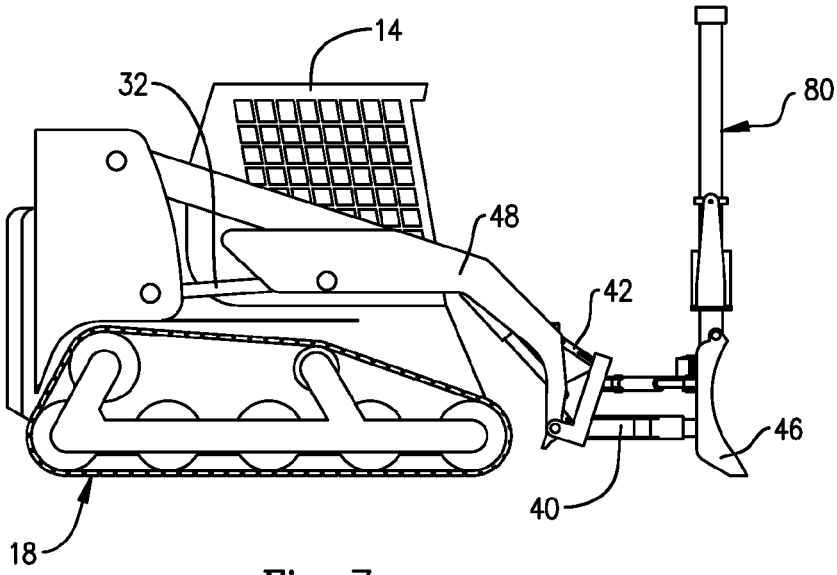
FIG. 7 is a side elevation view demonstrating blade lift low.
Figure 8:
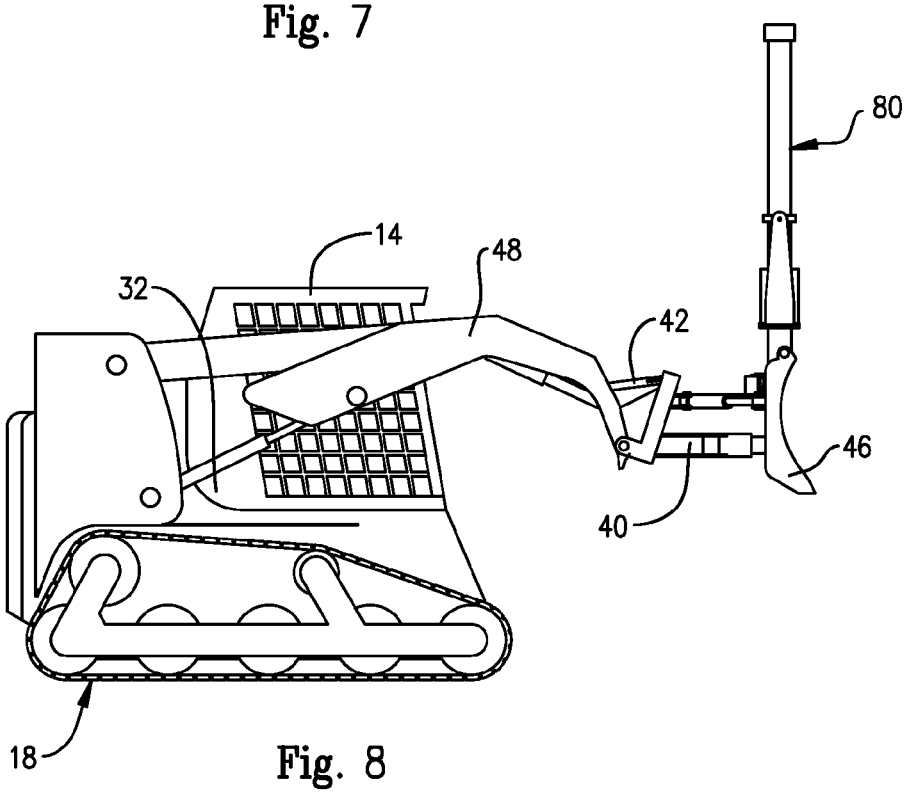
FIG. 8 is a side elevation view demonstrating blade lift high.

FIGS. 7 and 8 are a side elevation view of a skid steer vehicle with a dozer blade attachment demonstrating the lift axis that the operator of the vehicle (or the automatic grade control) can move the blade. The lift axis is powered by hydraulics 32. The grade control system as controlled by the leveler assembly 80 moves the blade 46 automatically on the lift axis by controlling the hydraulics 32.

Figure 9:
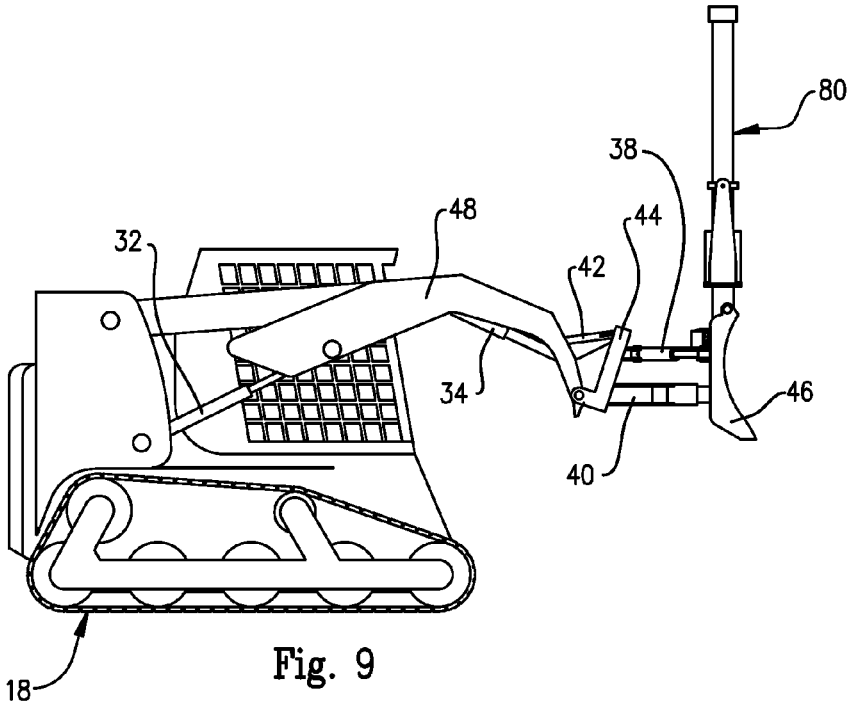
FIG. 9 is a side elevation view demonstrating blade pitch back.
Figure 10:
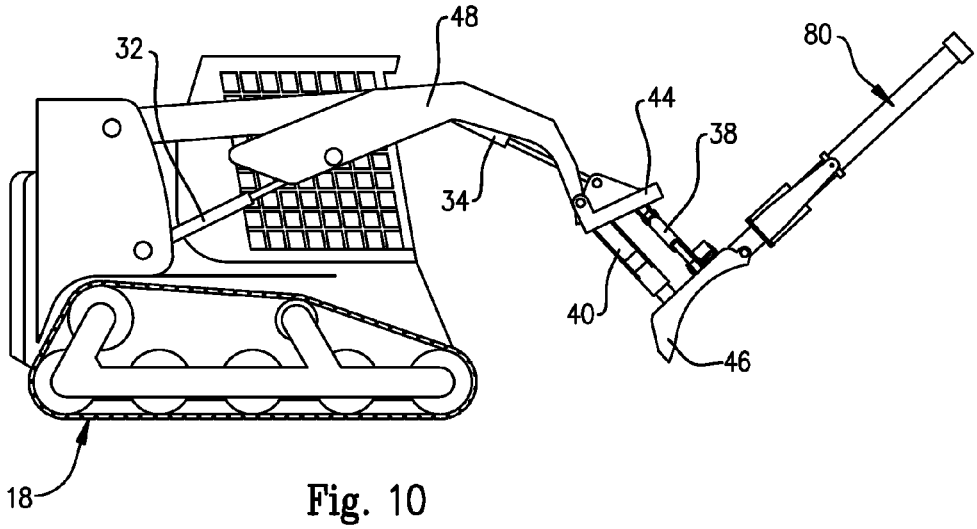
FIG. 10 is a side elevation view demonstrating blade pitch forward.

FIGS. 9 and 10 are a side elevation view of a skid steer vehicle with a dozer blade attachment demonstrating the pitch axis that the operator of the vehicle can move the blade. The pitch axis is of limited value when grading earth with a dozer blade 46. The pitch axis control is of greater importance when the skid steer vehicle is used with, for example, a scoop or bucket front end accessory so that material may be picked up in the scoop or bucket, carried to another location and then pitched forward to dump the contents. Other front end accessories may also benefit from the pitch axis of movement. The pitch axis is controlled by hydraulics 34.

A problem often arises when a small to medium sized skid steer is combined with an automatic grade control such as the laser automation as described above and including the leveler assembly 80 attached to the blade 46. The leveler assembly 80 measures the height of the blade 46 as compared to the remote beacon (not shown in the figures and described above) and adjusts the height of the blade 46 by controlling the hydraulics 32. The entire weight of the blade assembly 30 is held relative to the main arm 48 by the hydraulic 34. Hydraulic 34 is also responsible for the pitch axis of the blade 46. Hydraulic 34, due to the weight of the blade assembly 30, motion of the skid steer vehicle over terrain and other factors allows a bounce or movement between the main arm 48 and the blade assembly 30 which in turn imparts movement to the mast 84 and therefore also the receiver 82. This is the bouncing dozer blade problem.

Said bounce imparted onto the receiver 82 then gives the automatic grade control indication that the blade 46 is not at the correct height and the automatic grade control attempts to correct the movement by controlling hydraulic 32 to adjust the blade 46 height. This bounce and correction often cause a harmonic or further bounce to develop and causes the blade 36 to constantly move therefore the grade cannot be maintained. The faster the skid steer vehicle moves, the worse the bounce becomes.

A solution to the bouncing dozer blade problem has been employed in the prior art by not including a means to manipulate the pitch axis of the blade on the vehicle. This is commonly found in larger earthmoving equipment and is effective to stabilize many automatic grade control systems, such as a laser leveling system. This type of equipment is commonly called a bull dozer and generally performs the single function of grading soil.

Presumably by removing the blade pitch means on a small to medium skid steer vehicle the vehicle could employ an automatic grade control system such as a laser leveling system. However, small to medium sized vehicles are prized in large part to the availability of various interchangeable attachments as described above. By removing the pitch axis of movement the versatility of the machine would be somewhat reduced.

Several problems arise with the use of larger earth moving equipment. On confined job sites the maneuverability of smaller machines is essential to reduce the need for manual soil movement and avoiding damage to existing features (i.e. foundation piers, buried plumbing, etc). The greatly reduced weight of the small to medium sized skid steer permits traversing delicate surfaces such as over tree roots, sidewalks, grass or other surfaces. The smaller size of the small to medium skid steer allows it to fit into spaces that the dedicated bull dozers could not fit, for example, inside a pre-existing building or under other low obstructions. Each of these problems is solved by a small to medium sized skid steer vehicle with the capability to be used with an automatic grade control system such as a laser leveling system.

Figure 11:
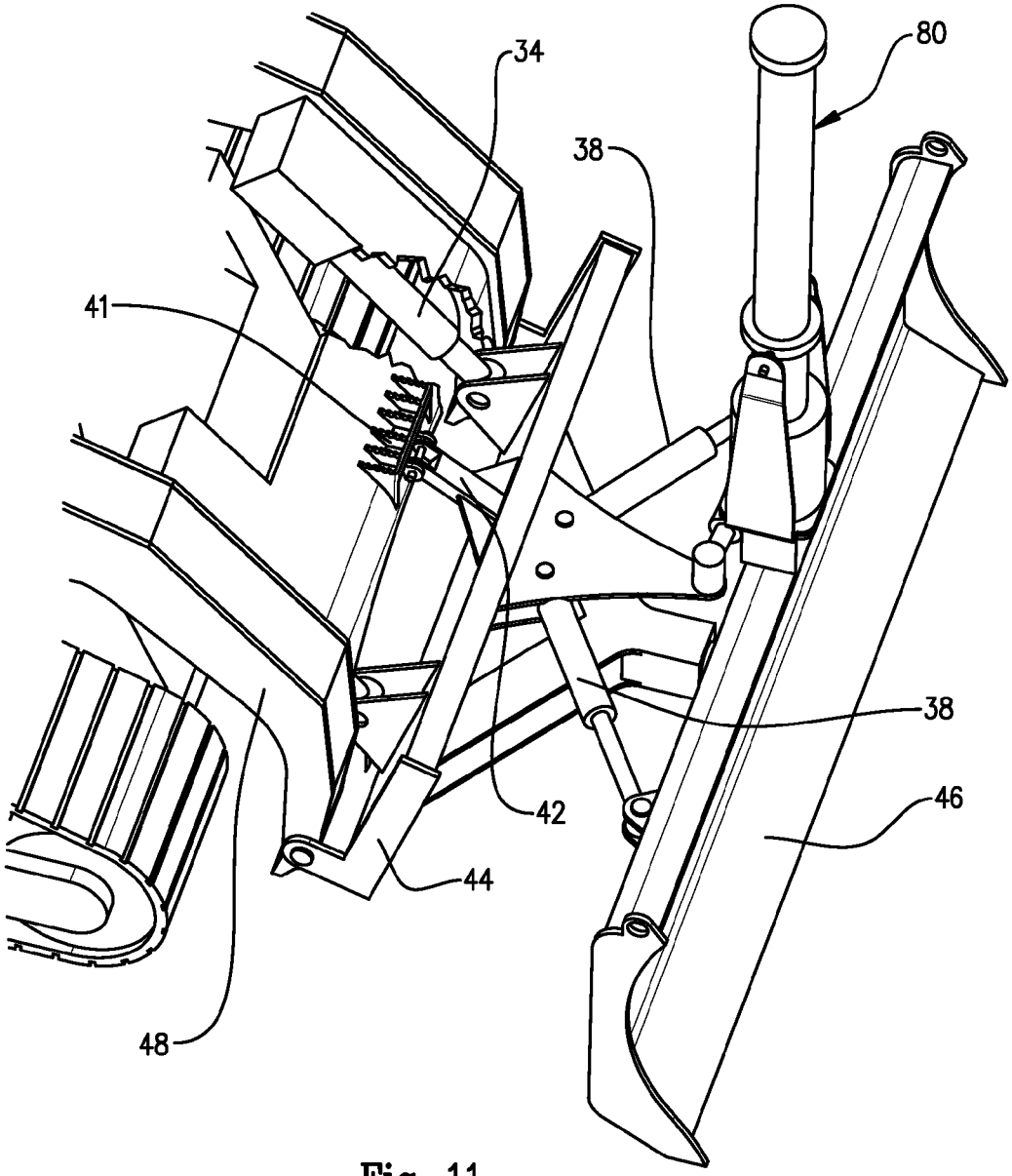
FIG. 11 is a partial perspective view of a blade assembly with a partial cut away.

FIG. 11 demonstrates an embodiment of the device including, inter alia, a hydraulic 34, a hydraulic 38, a guard 41, a bracket 42, a frame 44, a blade 46, a main arm 48 and a leveler assembly 80. A portion of the main arm 48 is cut away to show the hydraulic 34 more clearly.

If the bracket 42 were not present said hydraulic 34 would be able to move the blade 46 on the pitch axis as demonstrated in FIGS. 9 and 10.

Said bracket 42, when attached, acts to prevent hydraulic 34 from any movement and thereby preventing the blade 46 from any pitch movement. Said hydraulic 34 bears the weight of, inter alia, the frame 44, hydraulic 38, blade 46 and leveler assembly 80. This weight exerts substantial pressure on hydraulic 34 even when hydraulic 34 remains at rest. This substantial pressure against hydraulic 34 causes hydraulic 34 to move slightly or have play under the load. Bracket 42 prevents any play of the hydraulic 34 and thereby aids in preventing any bounce of the blade 46 and leveler assembly 80.

Without the bracket 42 the hydraulic 34 has enough play in it to allow the blade 46 to bounce thereby creating an unstable support for the leveler assembly 80. When the leveler assembly 80 bounces with the blade 46 the leveler assembly 80 cannot properly level the blade 46. When the skid steer vehicle moves, for example while grading a surface, the blade 46 begins to bounce and the leveler assembly 80 attempts to correct the bounce by adjusting the height of the main arm 48 but this correction frequently leads to an over correction and the blade 46 tends to bounce increasingly more.

In the embodiment of the bracket 42 shown in FIG. 11 the more forward end of the bracket 42 is connected to the frame 44 by welds. However, the more forward end of the bracket 42 could also be removably connected to the frame 44. The rearward end of the bracket 42 is shown to be removably connected to the main arm 48 by a pin. The pin can be removed to disconnect the bracket 42 from the main arm 48 so that the hydraulic 34 may be free to cause the pitch axis of movement of the blade 46.

Disconnecting the bracket 42 may be useful when attachments other than a dozer blade are attached to the skid steer vehicle. Therefore the full usefulness of the small to medium sized skid steer vehicle is retained because it can be used with any of the attachments including those that benefit from the pitch axis movement.

If the skid steer vehicle was made without the hydraulics to effect the pitch axis it may work well with an automatic grade control system but would loose versatility by limiting the available alternative attachments that require the pitch axis, such as a scoop or bucket.

Still referring to FIG. 11, said guard 41 is optionally present and partially covers the upper end of the bracket 42. The guard 41 is integral to the main arm 48. The guard 41 functions as a step and also to prevent human injury if the pin connecting the rearward end of the bracket 42 to the main arm 48 or the bracket 42 should break.

The length of the bracket 42 is such that when the bottom of the blade 46 is lowered to approximately the plane defined by the bottom edge of the tracks 18 the face of the blade 46 is substantially vertical to aid in the efficient cutting and moving of the soil being graded.

It would be appreciated by one commonly skilled in the art that the bottom of the blade 46 is often adjusted and/or calibrated so that the blade 46 would cut the soil slightly below the track height so that when the skid steer vehicle is moving forward the tracks 18 rest on the newly scraped surface.

Figure 12:
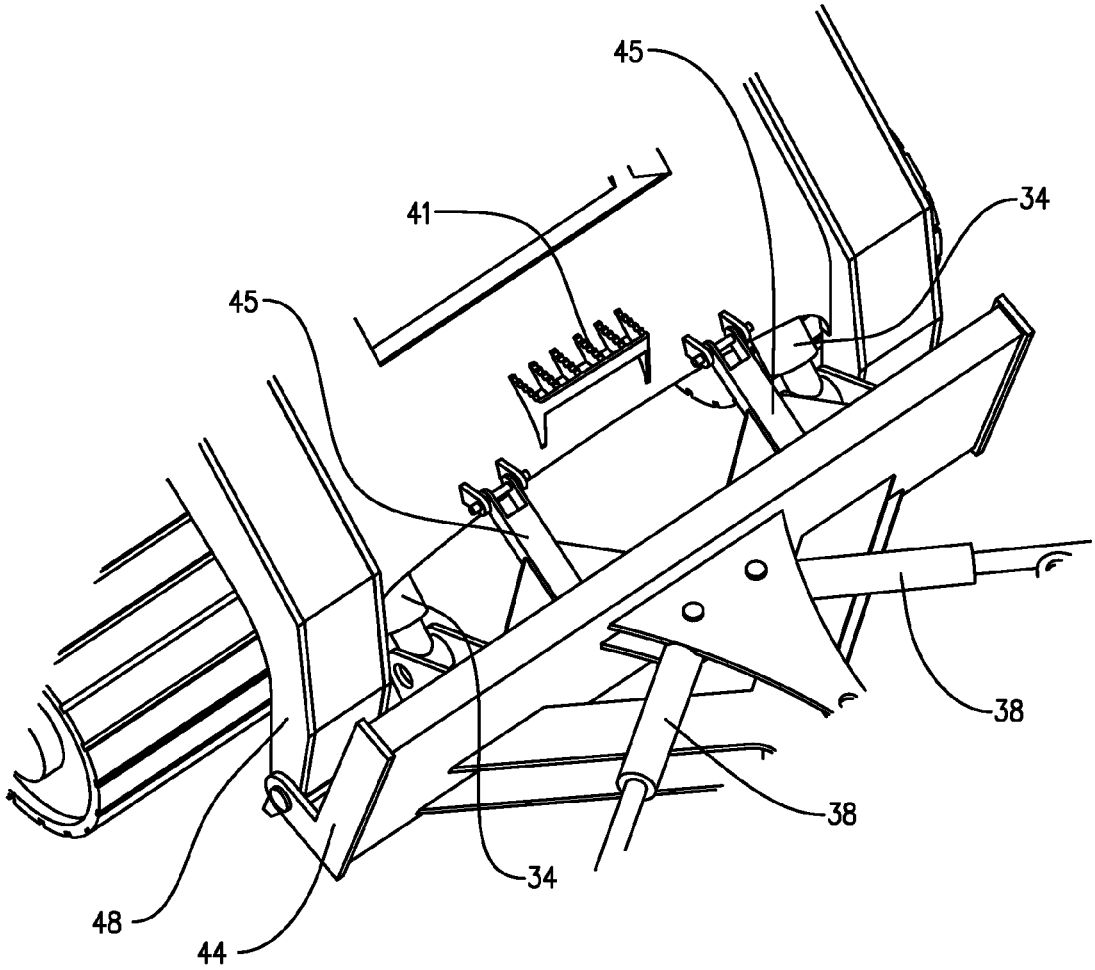
FIG. 12 is a partial perspective view of a blade assembly.

FIG. 12 shows the front end of a small to medium sized skid steer vehicle demonstrating an alternate bracket 45 as well as, inter alia, the guard 41, the main arm 48 the hydraulic 34, the hydraulic 38 and the frame 44. This embodiment is materially similar to that shown in FIG. 11 and described above except that in FIG. 11 there is a single bracket 42 where in the embodiment shown in FIG. 12 there are two brackets 45.

As in the other embodiments, brackets 45 act to prevent any movement, even slight play, in the hydraulic 34 that is responsible for causing the pitch axis motion as demonstrated in FIGS. 9 & 10. As described above, the pitch axis of motion is not needed for automatic grade control systems and allowing the hydraulic 34 to have even slight motion from play in the hydraulic the automatic grade control system, such as a laser leveler, will not function efficiently. Any bounce in the dozer blade attachment in front of the skid steer vehicle will necessarily cause the leveler assembly 80 (shown in FIG. 1) to bounce and make increasingly erratic corrections of the main arm 48 and thereby make an uneven grade surface.

In the embodiment of the bracket 42 shown in FIG. 12 the more forward end of the bracket 45 is connected to the frame 44 by welds. However, the more forward end of the bracket 45 could also be removably connected to the frame 44. The rearward end of the bracket 45 is shown to be removably connected to the main arm 48 by a pin. The pin can be removed to disconnect the bracket 45 from the main arm 48 so that the hydraulic 34 may be free to cause the pitch axis of movement of the blade 46 when the skid steer vehicle is used for other than with an automatic grade control system.

Figure 13:
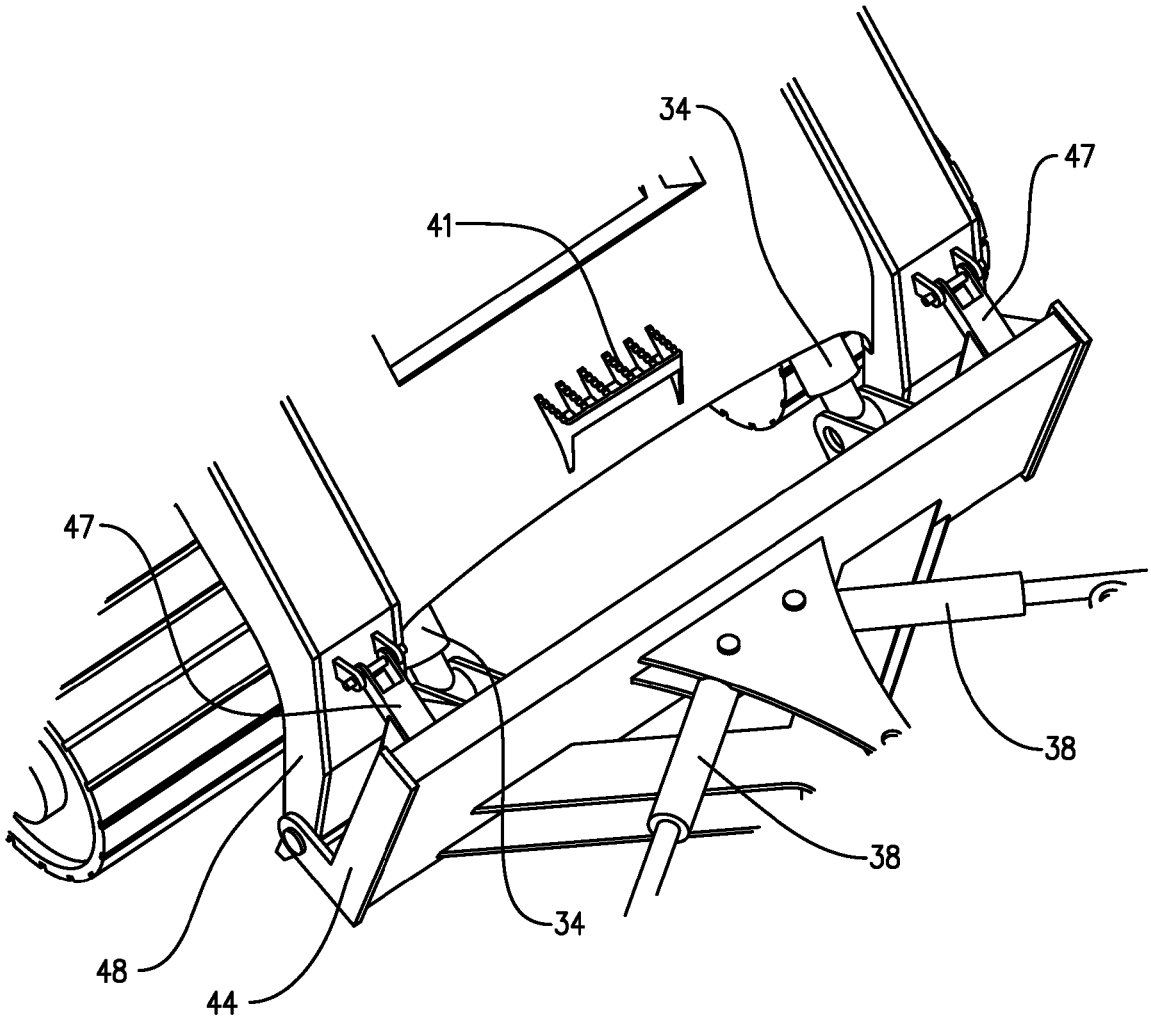
FIG. 13 is a partial perspective view of a blade assembly.

FIG. 13 shows another acceptable position of a pair of brackets 47 where they are connected to a more outward position on the main arm 48 and the frame 44. The bracket 47 prevents any movement of the hydraulic 34 and therefore any of the dozer blade assembly forward of the hydraulic 34. As in the other embodiments of the present device, the brackets 47 aid in providing a much more stable platform onto which to mount an automatic grade control system.

The hydraulics 34 are a significant source or cause of bouncing of a dozer blade attached to the skid steer in part due to the heavy load that the hydraulics 34 carry. The heavy load can force the hydraulics to have some movement which in turn causes the dozer blade to have some bounce when the skid steer vehicle is moving. The brackets 47 provide substantial additional support to the blade assembly 30 (shown in FIG. 1).

One commonly skilled in the art will appreciate a small to medium skid steer vehicle as contrasted to a larger dedicated purpose earthmoving vehicle such as a bulldozer.

One commonly skilled in the art will appreciate a small to medium skid steer vehicle may have either ground contacting tracks or wheels. In most environments a track style small to medium skid steer vehicle is preferred for its stability, traction and resistance to sinking in softer soils or creating ruts.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A method of stabilizing an automatic grade control system mast attached to a dozer blade assembly attached to a main arm of a skid steer vehicle comprising:

affixing one or more brackets with a first end to said dozer blade assembly and at a second end to said main arm to substantially prevent movement of one or more hydraulic actuators between said dozer blade assembly and said main arm that are capable of causing a pitch axis movement of said dozer blade assembly thereby substantially preventing said pitch axis movement of said dozer blade assembly and said automatic grade control system mast, without the need for ground contacting stabilizer wheels, while not affecting any other hydraulic actuators that may effect a roll axis movement or a yaw axis movement of said dozer blade assembly, wherein the main arm is coupled to hydraulic actuators for controlling lift axis movement of the dozer blade assembly.

2. A method as disclosed in claim 1 further characterized in that said automatic grade control system is a laser leveler system with a remote laser beacon or a global positioning based automatic grade control system.

3. A method as disclosed in claim 1 further characterized in that said one or more brackets are removable and re-attachable.

4. A method as disclosed in claim 1 further characterized in that said one or more brackets are dimensioned so that when a lower edge of said dozer blade assembly is at the same height as the bottom edge of said skid steer vehicle the dozer blade is substantially vertical.

5. A combination comprising:

a skid steer vehicle having a main arm onto which various commercially available accessories could be attached;

a dozer blade assembly affixed to said main arm of said skid steer vehicle, wherein said main arm is operably coupled to hydraulic actuators for controlling lift movement of said dozer blade along a lift axis;

said dozer blade assembly having a dozer blade with a multiplicity of hydraulic actuators that independently control a pitch, yaw and roll axis of movement of the dozer blade;

an automatic grade control system affixed to said dozer blade assembly; and one or more brackets attached between said main arm and said dozer blade assembly thereby substantially preventing movement of said one or more hydraulic actuators that control the pitch axis of movement of the dozer blade, without the need for ground contacting stabilizer wheels, and while not affecting said one or more hydraulic actuators that control said roll axis and said yaw axis of movement of the dozer blade.

6. A method of stabilizing an automatic grade control system attached to a dozer blade assembly on a skid steer vehicle, comprising:

providing a skid steer vehicle having a main arm, wherein the main arm is operably coupled to lift axis hydraulic actuators for moving the main arm on a lift axis of movement;

providing a dozer blade assembly operably coupled to the main arm, wherein the dozer blade assembly further comprises a frame, a dozer blade having a ground contacting lower edge and a plurality of hydraulic actuators disposed between and coupled to the frame and the dozer blade, having pitch axis hydraulic actuators, yaw axis hydraulic actuators and roll axis hydraulic actuators for independently actuating movement of the dozer blade along a pitch axis of movement, a yaw axis of movement and a roll axis of movement;

coupling at least one bracket having a forward end and a rearward end to the frame on the forward end, and the main arm on the rearward end, thereby restricting movement of the pitch axis hydraulic actuators, without the need for ground contacting stabilizer wheels;

allowing unrestricted movement of the yaw axis hydraulic actuators, roll axis hydraulic actuators and the lift axis hydraulic actuators;

setting the dozer blade in a desired configuration for grading; and mounting the automatic grade control system to the dozer blade.

7. The method of claim 6, wherein the step of coupling at least one bracket having a forward end and a rearward end further comprises:

removably coupling the at least one bracket to the frame on the forward end.

8. The method of claim 6, wherein the step of coupling at least one bracket having a forward end and a rearward end further comprises:

removably coupling the at least one bracket to the main arm on the rearward end.

9. The method of claim 6, wherein the step of coupling at least one bracket having a forward end and a rearward end further comprises:

coupling at least one bracket dimensioned such that when the ground contacting lower edge of the dozer blade is positioned at a common plane as a bottom edge of the skid steer vehicle, the dozer blade is substantially vertical.

10. The method of claim 9, wherein the step of mounting the automatic grade control system further comprises:

mounting a mast having a remote laser receiver to the dozer blade, wherein the remote laser receiver is capable of communicating with a reference beacon.

* * * * *